US009679682B2

(12) United States Patent
Wall

(10) Patent No.: US 9,679,682 B2
(45) Date of Patent: Jun. 13, 2017

(54) FENCE POST INSULATOR FOR ELECTRIFIABLE PLASTIC COATED WIRE

(71) Applicant: John Wall, Inc., Carmichaels, PA (US)

(72) Inventor: John R. Wall, Carmichaels, PA (US)

(73) Assignee: John Wall, Inc., Carmichaels, PA (US)

( * ) Notice: Subject to any disclaimer, the term of this patent is extended or adjusted under 35 U.S.C. 154(b) by 0 days.

(21) Appl. No.: 14/835,012

(22) Filed: Aug. 25, 2015

(65) Prior Publication Data

US 2017/0062101 A1 Mar. 2, 2017

(51) Int. Cl.
*H01B 17/14* (2006.01)

(52) U.S. Cl.
CPC ..... *H01B 17/145* (2013.01)

(58) Field of Classification Search
USPC ..... 174/138 F, 163 F, 161 F; 256/10; 248/72
See application file for complete search history.

(56) References Cited

U.S. PATENT DOCUMENTS 2,537,719 A * 1/1951 Tuepker ..... H01B 17/145 174/163 F
3,572,639 A 3/1971 Shettel
3,652,780 A * 3/1972 Wilson ..... H01B 17/145 174/163 F
3,654,383 A 4/1972 Wilson
3,684,247 A * 8/1972 Oltmanns ..... E04H 17/10 174/158 F
3,752,902 A 8/1973 Wilson
3,977,653 A * 8/1976 Fingerson ..... E04H 17/10 256/10
4,077,611 A 3/1978 Wilson
4,771,137 A 9/1988 Thompson
4,845,317 A * 7/1989 Wilson, Jr. ..... H01B 17/145 174/163 F
4,905,968 A 3/1990 Eby et al.
5,063,274 A 11/1991 Johnson
5,975,501 A 11/1999 Berg et al.
6,489,569 B1 12/2002 Thomson
6,583,363 B1 6/2003 Wilson, Jr.
6,872,892 B1 3/2005 Burdick
2002/0025218 A1* 2/2002 Tan ..... H01B 17/145 403/322.4

FOREIGN PATENT DOCUMENTS

FR 2299707 A1 8/1976

* cited by examiner

*Primary Examiner* — Dhirubhai R Patel
(74) *Attorney, Agent, or Firm* — The Webb Law Firm

(57) ABSTRACT

An insulator for holding an electrifiable wire includes a base, a first connecting portion provided on a first end of the base, and a second connecting portion provided on a second end of the base. The first connecting portion and the second connecting portion may be movable between a first, open position and a second, closed position.

11 Claims, 4 Drawing Sheets

FENCE POST INSULATOR FOR ELECTRIFIABLE PLASTIC COATED WIRE

BACKGROUND OF THE INVENTION

Field of the Invention

This disclosure relates generally to insulator clips and, more particularly, to fence post insulators for electrifiable plastic coated wire.

Description of Related Art

Current fence post insulators used today are configured to support an electrifiable or conducting material for electric fences. The insulators are typically secured to a fence post or structure using screws, nails, staples, and other fastening members. To secure the insulators to the fence post or structure, an individual is required to hold both the insulator and the fastening element to attach the insulator to the fence post or structure. Since the individual must use both hands to align separate elements, this can often be a difficult and lengthy process for an individual who needs to install a large quantity of insulators around an enclosed area. It also becomes difficult to run the electrifiable wire through the insulator after the insulator has been installed on the fence post or structure. To ease the installation of the electrifiable wire into the insulator, current insulators include an open aperture that permits the electrifiable wire to be inserted therein using an interference fit. Typically, the aperture remains open on the insulator permitting the electrifiable wire to be inadvertently pulled out of the insulator. In the event an object, such as a fenced-in animal, contacts the electrifiable wire or fence post, the electrifiable wire may be pulled out of the open aperture of the insulator.

U.S. Pat. No. 6,489,569 to Thomson, the disclosure of which is incorporated in its entirety by reference, discloses a typical fence post insulator. The insulator is fastened to a fence post or structure using a plurality of nails. After the insulator has been installed, an electrifiable wire is pressed into the open aperture of the insulator past an interference fit to hold the electrifiable wire in the insulator. After installation of the wire, however, the aperture remains open. The aperture is not closed to retain the electrifiable wire in the insulator. Therefore, the electrifiable wire is capable of becoming loose and falling out of the insulator.

Many current electric fence insulators are designed and manufactured for semi-permanent installations. These insulators are lightweight to reduce the cost of manufacturing and rely on the psychological barrier of an electrified barrier to keep an animal in an enclosed area. Typically, an electrifiable twine (polywire) or even lightweight steel wire is used in the insulators and can create a maintenance issue that requires daily inspections and repairs.

In recent years, a new electrifiable plastic coated fence wire has become widely used in the equine market worldwide because of its safety factor to animals and reduced likelihood of entanglement. Therefore, this long-lasting, permanent fencing material requires a rugged, functional, and uniquely designed insulator to match the permanency of the material the insulator holds. In view of the foregoing, a need exists for a fence post insulator that is easily attached to an electrifiable wire and to a fence post or structure. A further need exists for a fence post insulator that effectively and securely retains an electrifiable wire within the insulator.

SUMMARY OF THE INVENTION

Accordingly, and generally, a fence post insulator for electrifiable plastic coated wire is provided to address and/or overcome some or all of the deficiencies and drawbacks associated with existing fence post insulators.

In a first aspect, an insulator for holding an electrifiable wire may include a base, a first connecting portion provided on a first end of the base, and a second connecting portion provided on a second end of the base. The first connecting portion and the second connecting portion may be movable between a first, open position and a second, closed position.

The first connecting portion may include a substantially C-shaped end. The second connecting portion may include a substantially C-shaped end. The base may be made of a flexible material. The base may be movable from an arcuate first position to a substantially planar second position. A first aperture may be defined in the first connecting portion. A second aperture may be defined in the second connecting portion. The first aperture may include a first seat surface. The second aperture may include a second seat surface. The base may be substantially circular. The insulator may be formed as a monolithic unit.

In a second aspect, a method of retaining an electrifiable wire in an insulator may include inserting an electrifiable wire into an aperture defined by a first connecting portion and a second connecting portion of the insulator, and rotating the first connecting portion and the second connecting portion towards one another to close the aperture. The method may also include pressing one of the first connecting portion and the second connecting portion against a base of the insulator to cause the first connecting portion and the second connecting portion to rotate towards one another. The method may also include gripping the first connecting portion and the second connecting portion to manually rotate the first connecting portion and the second connecting portion towards one another.

These and other features and characteristics of the fence post insulator, as well as the method of installing the fence post insulator, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENT

Figure 1:
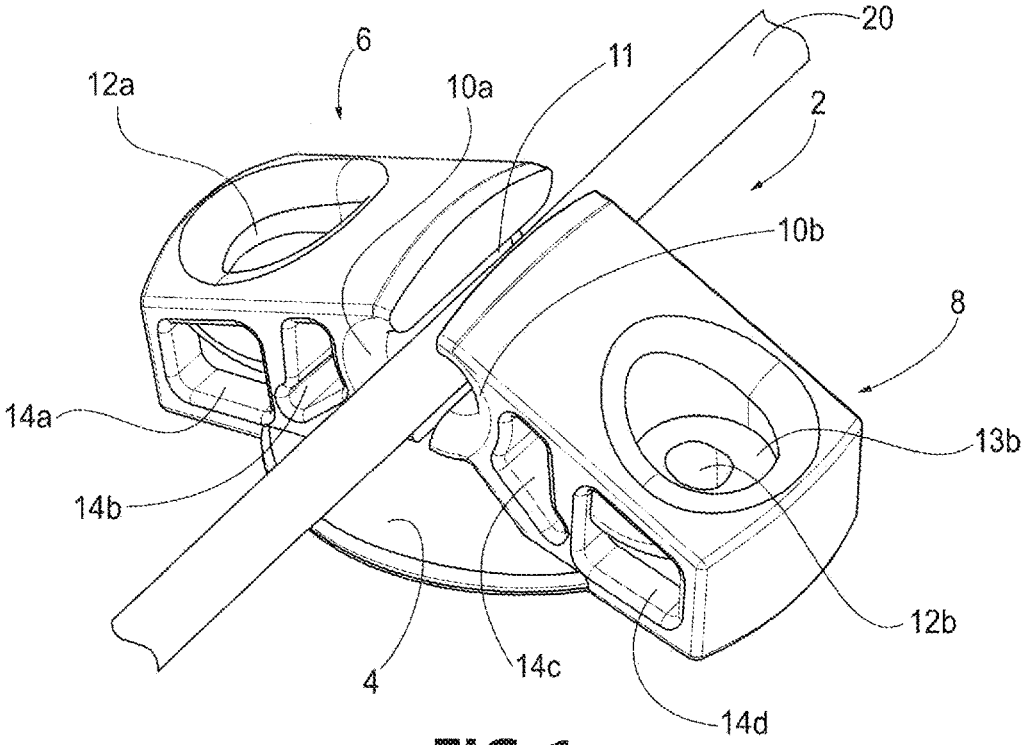
FIG. 1 is a side perspective view of a fence post insulator including an electrifiable wire installed therein according to an aspect of this disclosure.
Figure 2:
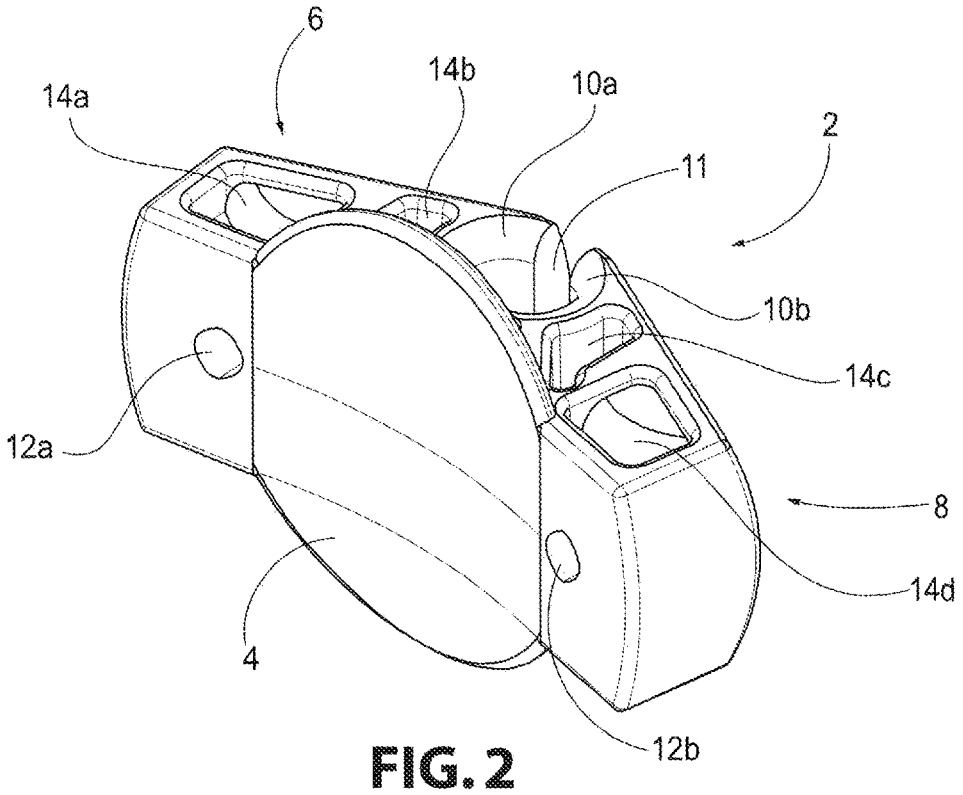
FIG. 2 is a rear perspective view of the fence post insulator of FIG. 1.
Figure 3:
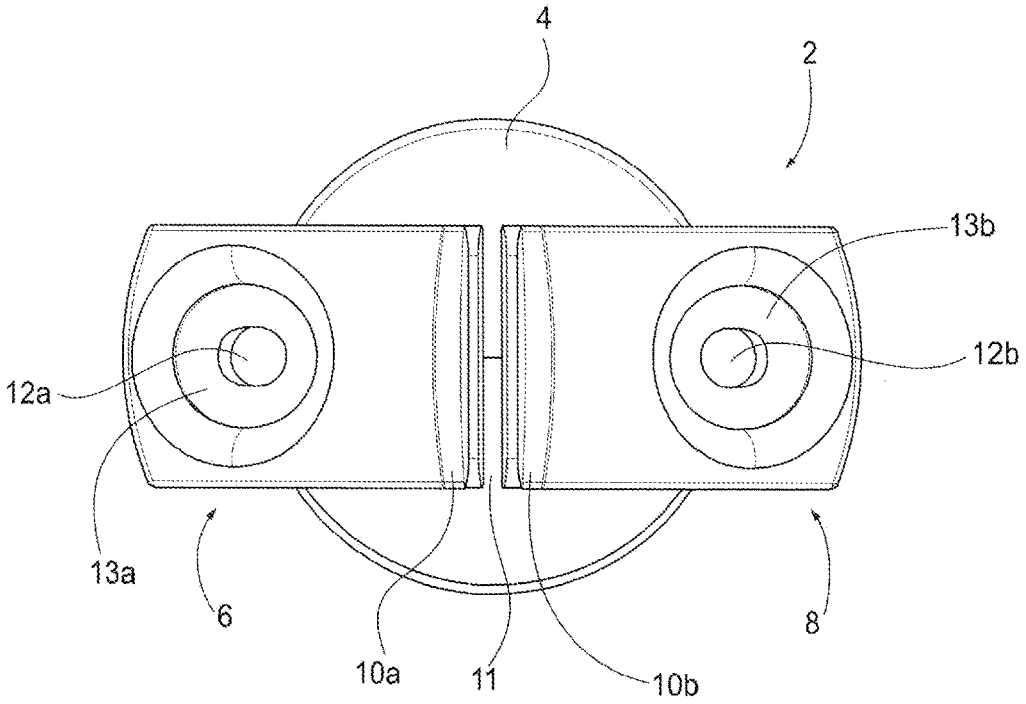
FIG. 3 is a front view of the fence post insulator of FIG. 1.

For purposes of the description hereinafter, the terms "upper", "lower", "right", "left", "vertical", "horizontal", "top", "bottom", "lateral", and "longitudinal", and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary aspects of the invention. Hence, specific dimensions and other physical characteristics related to the aspects disclosed herein are not to be considered as limiting.

The present disclosure is directed to, in general, a fence post insulator for electrifiable wire and a method of installing electrifiable wire into the fence post insulator. Certain preferred and non-limiting aspects of the components of the fence post insulator are illustrated in FIGS. 1-8. Although the following description describes the fence post insulator in use with a fence post, it is also to be understood that the insulator may be used on alternative materials such as wood, steel, piping, plastic, or composite posts.

Figure 4:
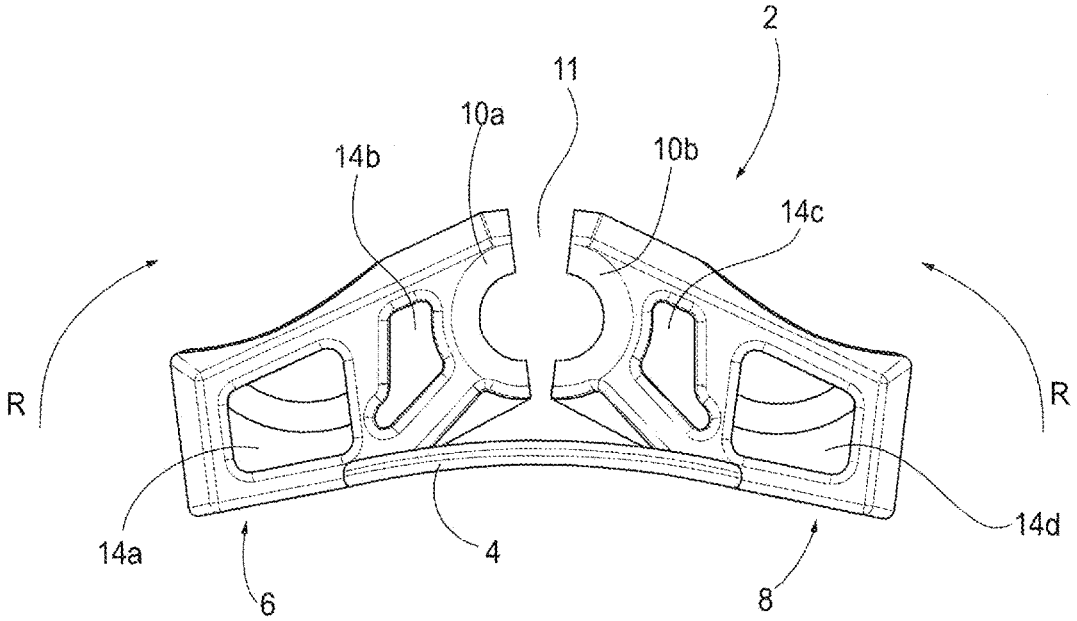
FIG. 4 is a side view of the fence post insulator of FIG. 1 in a first, open position.
Figure 5:
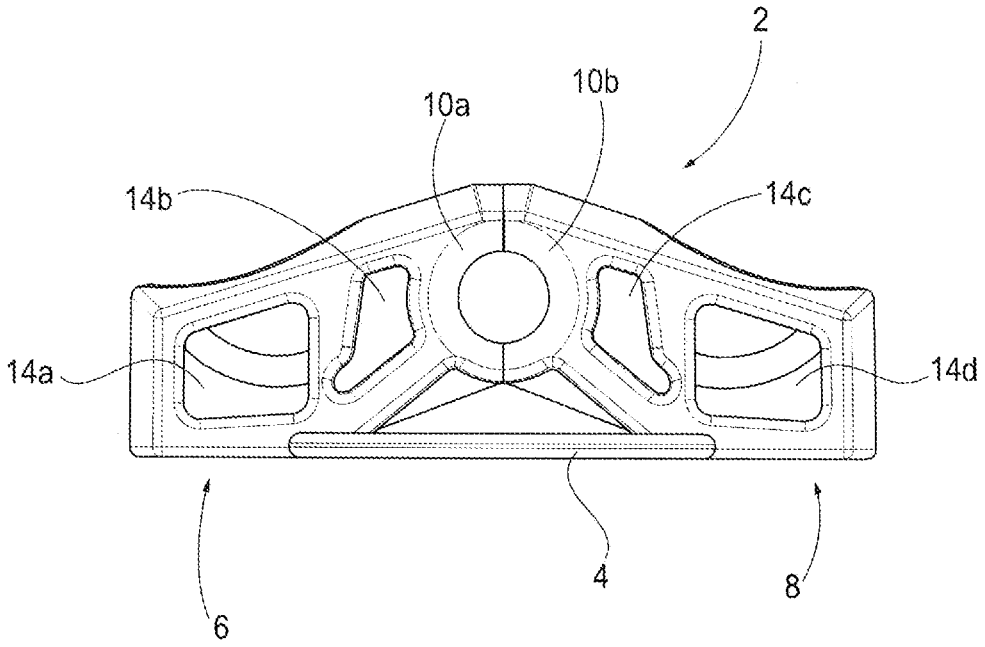
FIG. 5 is a side view of the fence post insulator of FIG. 1 in a second, closed position.
Figure 6:
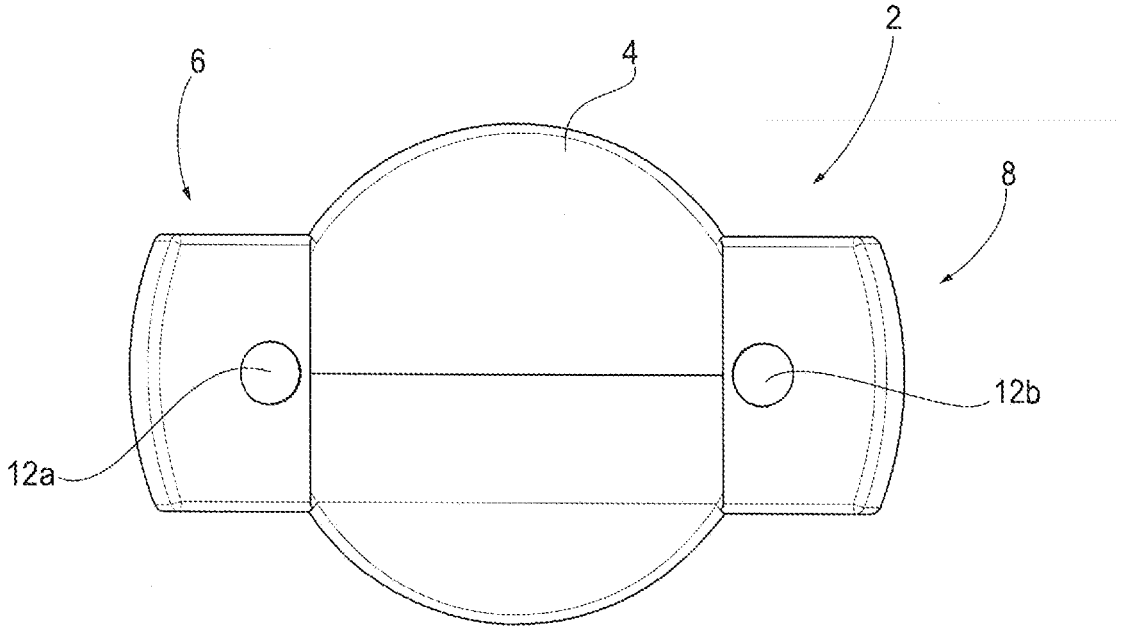
FIG. 6 is a rear view of the fence post insulator of FIG. 1.
Figure 7:
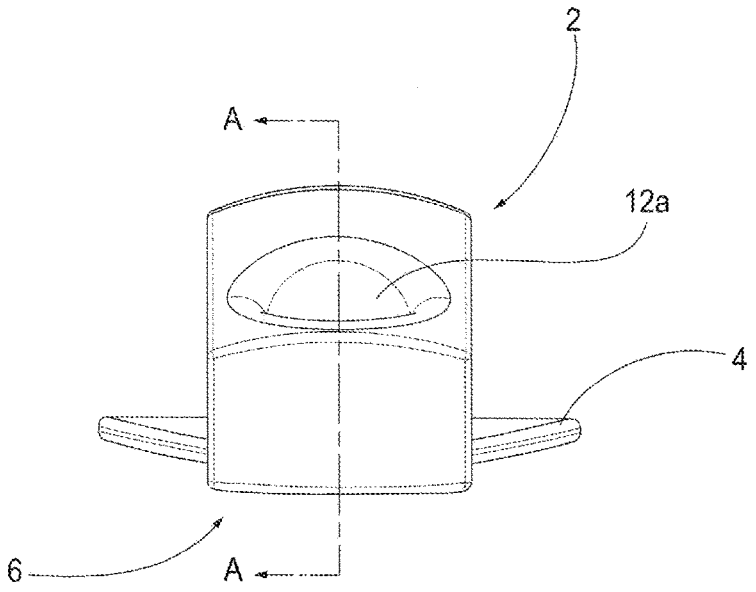
FIG. 7 is a bottom view of the fence post insulator of FIG. 1.
Figure 8:
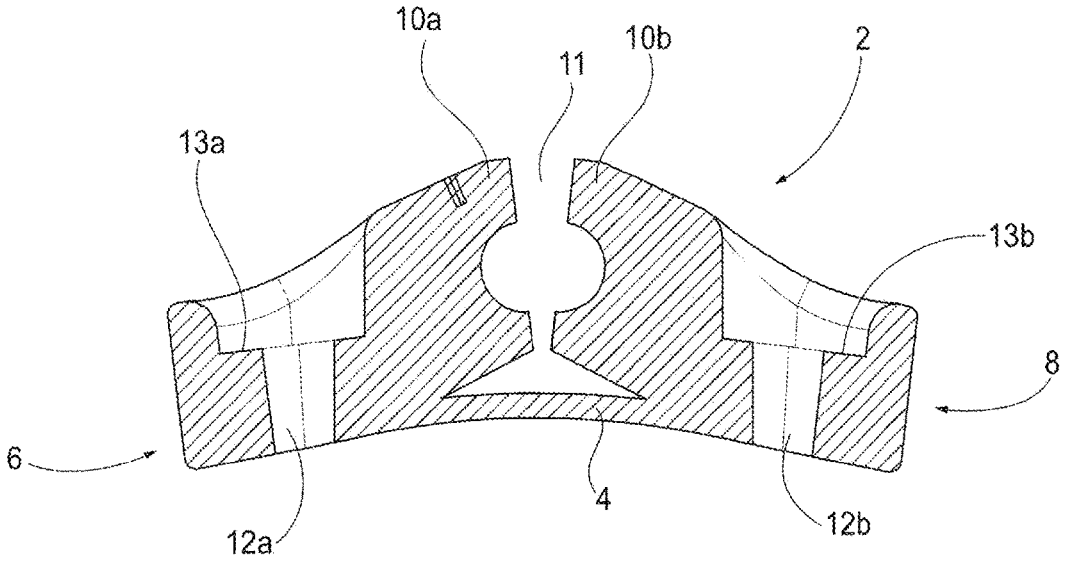
FIG. 8 is a cross-sectional view of the fence post insulator of FIG. 1 along line A-A of FIG. 7.

With reference to FIGS. 1-8, a fence post insulator 2 (hereinafter referred to as "insulator 2") is described. The insulator 2 includes a base 4 (also referred to as a spark guard), a first connecting portion 6, and a second connecting portion 8. The base 4, first connecting portion 6, and second connecting portion 8 may be formed and manufactured as a single, monolithic structure or assembled as separate individual components that are welded, fastened, or adhesively connected to one another. In one aspect, the base 4 may have a generally circular shape. The base 4 may be made of a substantially flexible material, such as plastic. Plastic provides strength, flexibility, and acceptance of UV stabilizers for the insulator 2. Further, the insulator 2 may be formed from plastic that is different from the plastic used to coat an electrifiable wire 20 held in the insulator 2 to reduce friction when sliding the electrifiable wire 20 through the insulator 2, thereby reducing wear and tear on the insulator 2 when under tension. As shown in FIG. 4, in a first, open position of the insulator 2, the base 4 may be biased into a curved position. As shown in FIG. 5, in a second, closed position of the insulator 2, the base 4 may be snapped into a substantially straight, planar configuration. The installation and use of the insulator 2 will be described in greater detail below.

In one aspect, the first connecting portion 6 and the second connecting portion 8 are substantially identical to one another. It is also contemplated that the dimensions and shape of the connecting portions 6, 8 may differ slightly from one another. The connecting portions 6, 8 are generally rectangular in shape and include a substantially C-shaped opening 10*a*, 10*b* provided on an inner surface thereof. The openings 10*a*, 10*b* are configured to receive an electrifiable wire 20 (shown in FIG. 1) to hold to a fence post. In one aspect, the electrifiable wire 20 may be a 12.5 gauge, high tensile strength wire. Current insulator clips are more light weight and designed to hold lighter weight wire, which is easily dislodged from the fence post upon an animal or object contacting the wire. The current insulator 2 is configured to receive and hold a larger electrifiable wire, which is more difficult for an animal or object to dislodge from a fence post. In the first, open position of the insulator 2, the openings 10*a*, 10*b* are positioned apart from one another to define a passageway 11 to permit the electrifiable wire 20 to be inserted therethrough. In the second, closed position of the insulator 2, the openings 10*a*, 10*b* may abut one another to close the passageway 11 to prevent the electrifiable wire 20 from falling or pulling out of the openings 10*a*, 10*b*. As shown in FIG. 5, when the insulator 2 is in the second closed position, the openings 10*a*, 10*b* may be configured to form a closed circular opening. It is also contemplated that the openings 10*a*, 10*b* may not abut one another in the second, closed position, but instead they may leave a small gap between one another. This gap may be small enough to prevent the electrifiable wire 20 from being pulled out of the insulator 2. However, it is preferred that the openings 10*a*, 10*b* abut one another to close the opening to restrict moisture from contacting the electrifiable wire 20, which could become a conductor for electrical shorting.

The connecting portions 6, 8 may also define a central aperture 12*a*, 12*b* to receive a fastening member (not shown) to fasten the insulator 2 to a fence post. The fastening member may be a nail, screw, bolt, staple, pin, or any other suitable fastener to hold the insulator 2 to a fence post. In one aspect, the fastening member may be a shouldered, self-tapping attaching screw for the fence post, which may be used on wood, steel, or plastic. The central apertures 12*a*, 12*b* may be circular in shape and extend from a front surface of each respective connecting portion 6, 8 to a rear surface of each respective connecting portion 6, 8. In one aspect, the upper edges of the central apertures 12*a*, 12*b* may be chamfered to assist in directing the fastening members into the central apertures 12*a*, 12*b*. Although the central apertures 12*a*, 12*b* may not be chamfered by providing a squared-off edge entrance and exit for the central apertures 12*a*, 12*b*, this may result in damage to the tensioned electrifiable wire 20 through impact or contraction and expansion. Each central aperture 12*a*, 12*b* may also include a seat 13*a*, 13*b* configured to catch and support a head or portion of a fastening member to limit the length of the fastening member that is inserted into the fence post. A plurality of side apertures 14*a*-14*d* may also be defined in the connecting portions 6, 8. Two of the apertures 14*a*, 14*d* may extend into the connecting portions 6, 8, but not so far as to extend into the central apertures 12*a*, 12*b*. Two of the apertures 14*b*, 14*c* may extend from a first side of each respective connecting portion 6, 8 into a portion of the respective connecting portion 6, 8 closer to the center of the insulator 2, but not so far as to extend into the opening formed by the connecting portions 6, 8. The same type of apertures 14*a*-14*d* may also be provided on a second side of the insulator 2. The apertures 14*a*-14*d* may be provided to reduce the material needed to manufacture and from the insulator 2. The apertures 14*b*, 14*c* may be configured so as not to extend into the opening defined by the connecting portions 6, 8 so that dust, cob webs, and other debris is not permitted to deposit in the opening defined by the connecting portions 6, 8, which can cause the electrifiable wire 20 to short out.

With reference to FIGS. 4 and 5, a method of installing one electrifiable wire 20 into the insulator 2 and a method of fastening the insulator 2 to a fence post is described. Initially, the insulator 2 may be formed/manufactured into a first open position (shown in FIG. 1). In the first, open position, the openings 10*a*, 10*b* of the connecting portions 6, 8 are positioned apart from one another to create the passageway 11. The individual will then insert the electrifiable wire 20 through the passageway 11 into the openings 10*a*, 10*b*. The electrifiable wire 20 may be freely inserted through the passageway 11 so as not to contact the sides of the openings 10*a*, 10*b* or the openings 10*a*, 10*b* may be positioned close enough together to create an interference fit with the electrifiable wire 20.

After the electrifiable wire 20 has been inserted into the openings 10*a*, 10*b*, the individual may press either the first connecting portion 6 or the second connecting portion 8 against the base 4 to cause the connecting portions 6, 8 to rotate inwardly in a rotational direction R (shown in FIG. 4). As the connecting portions 6, 8 are pressed, the base 4 is flattened into a substantially straight, planar orientation to snap together the openings 10*a*, 10*b* of the connecting portions 6, 8. The openings 10*a*, 10*b* are brought into abutment with one another to close the electrifiable wire 20 inside of the insulator 2. When the openings 10*a*, 10*b* are brought into abutment, the passageway 11 is closed to retain the electrifiable wire 20 in the insulator 2. After the connecting portions 6, 8 have been rotated to retain the electrifiable wire 20 in the insulator 2, the insulator 2 may be fastened to the fence post by inserting fastening members through the central apertures 12*a*, 12*b* of the connecting portions 6, 8. This method may be repeated for each insulator 2 to form a fenced-in area. By retaining the electrifiable wire 20 in the insulator 2 before fastening the insulator 2 to the fence post, the individual can properly visualize the position of and orient the insulator 2 and electrifiable wire 20 on the fence post at a desired position. Unlike current insulators that need to be removed from the fence post to re-adjust the position of the electrifiable wire 20 on the fence post, the insulator 2 of the present disclosure may be properly positioned prior to fastening the insulator 2 on the fence post.

In an alternative aspect, after the electrifiable wire 20 has been inserted into the openings 10*a*, 10*b*, the individual may instead grip both connecting portions 6, 8 and rotate the connecting portions 6, 8 inwardly in a rotational direction R (shown in FIG. 4). As the connecting portions 6, 8 are rotated, the base 4 is flattened into a substantially straight, planar orientation to snap together the openings 10*a*, 10*b* of the connecting portions 6, 8. The openings 10*a*, 10*b* are brought into abutment with one another to close the electrifiable wire 20 inside of the insulator 2. When the openings 10*a*, 10*b* are brought into abutment, the passageway 11 is closed to retain the electrifiable wire 20 in the insulator 2. In a further alternative aspect, instead of rotating the connecting portions 6, 8 by hand, the individual can position the insulator 2 on the fence post and fasten the insulator 2 to the fence post by inserting fastening members through the central apertures 12*a*, 12*b*. As the fastening members are inserted further into the central apertures 12*a*, 12*b*, the connecting portions 6, 8 are rotated in rotational direction R against the fence post. As the connecting portions 6, 8 are rotated, the openings 10*a*, 10*b* are brought into abutment to retain the electrifiable wire 20 in the insulator 2. Using this method, an individual may simultaneously fasten the insulator 2 to the fence post and retain the electrifiable wire 20 in the insulator 2. After the insulator 2 has been fastened to the fence post, a small gap may be established between the base 4 and the fence post. In one aspect, the distance defined by the gap between the base 4 and the fence post may be approximately 0.025 inches. By defining this small gap, the insulator 2 may be provided on a plurality of different fence posts that may have variable surfaces. The base 4 may also be slightly flexible to allow play in the base 4 to adapt to the variable surfaces of the different fence posts. In one aspect, the base 4 may be angled 2 degrees relative to the fence post.

While various aspects of the insulator were provided in the foregoing description, those skilled in the art may make modifications and alterations to these aspects without departing from the scope and spirit of the invention. For example, it is to be understood that this disclosure contemplates that, to the extent possible, one or more features of any aspect may be combined with one or more features of any other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. An insulator for holding an electrifiable wire, comprising: a base; a first connecting portion provided on a first end of the base; and a second connecting portion provided on a second end of the base, wherein the first connecting portion and the second connecting portion are rotatable between a first, open position inwardly to a second, closed position so that, upon an individual providing pressure on at least one of the first connecting portion and the second connecting portion, the first connecting portion and the second connecting portion are snapped together to retain the electrifiable wire within the insulator.

2. The insulator as claimed in claim 1, wherein:

the first connecting portion comprises a substantially C-shaped end; and the second connecting portion comprises a substantially C-shaped end.

3. The insulator as claimed in claim 1, wherein the base is made of a flexible material.

4. The insulator as claimed in claim 1, wherein the base is movable from an arcuate first position to a substantially planar second position.

5. The insulator as claimed in claim 1, further comprising:

a first aperture defined in the first connecting portion; and a second aperture defined in the second connecting portion.

6. The insulator as claimed in claim 5, wherein:

the first aperture comprises a first seat surface; and the second aperture comprises a second seat surface.

7. The insulator as claimed in claim 1, wherein the base is substantially circular.

8. The insulator as claimed in claim 1, wherein the insulator is formed as a monolithic unit.

9. A method of retaining an electrifiable wire in an insulator, comprising:

a. inserting an electrifiable wire into an aperture defined by a first connecting portion and a second connecting portion of the insulator; and b. applying pressure by an individual to at least one of the first connecting portion and the second connecting portion to rotate the first and second connecting portions and snap the first connecting portion and the second connecting portion towards one another to close the aperture.

10. The method as claimed in claim 9, further comprising pressing one of the first connecting portion and the second connecting portion against a base of the insulator to cause the first connecting portion and the second connecting portion to rotate towards one another.

11. The method as claimed in claim 9, further comprising gripping the first connecting portion and the second connecting portion to manually rotate the first connecting portion and the second connecting portion towards one another.

* * * * *